US009186534B2

(12) United States Patent
Bollers et al.

(10) Patent No.: US 9,186,534 B2
(45) Date of Patent: Nov. 17, 2015

(54) ATHLETIC AGILITY EQUIPMENT AND METHODS OF USING THE SAME

(76) Inventors: Trevor Bollers, North Liberty, IA (US); Jennifer Bollers, North Liberty, IA (US)

( * ) Notice: Subject to any disclaimer, the term of this patent is extended or adjusted under 35 U.S.C. 154(b) by 0 days.

(21) Appl. No.: 13/468,014

(22) Filed: May 9, 2012

(65) Prior Publication Data

US 2013/0072354 A1 Mar. 21, 2013

Related U.S. Application Data

(60) Provisional application No. 61/438,936, filed on May 9, 2011.

(51) Int. Cl.
*A63B 21/00* (2006.01)
*A63B 5/22* (2006.01)
*A63B 71/02* (2006.01)

(52) U.S. Cl.
CPC ..... *A63B 5/22* (2013.01); *A63B 2071/026* (2013.01); *A63B 2225/093* (2013.01)

(58) Field of Classification Search
CPC ..... A63B 21/00
USPC ..... 482/904, 121, 27, 28
See application file for complete search history.

(56) References Cited

U.S. PATENT DOCUMENTS

| | | | | |
|---|---|---|---|---|
| 2,354,050 | A * | 7/1944 | Paupa | 434/255 |
| 4,134,586 | A * | 1/1979 | King | 473/440 |
| 8,460,129 | B2 * | 6/2013 | Forlini et al. | 473/435 |
| 2004/0087420 | A1 * | 5/2004 | Montesquieux | 482/129 |
| 2015/0099609 | A1 * | 4/2015 | White et al. | 482/23 |

* cited by examiner

*Primary Examiner* — Jerome w Donnelly
(74) *Attorney, Agent, or Firm* — Scherrer Patent & Trademark Law, P.C.; Stephen T. Scherrer; Monique A. Morneault

(57) ABSTRACT

The present invention relates to a grid apparatus that is useful for the training of athletes in speed, agility, strength, plyometrics, balance, cardiovascular and other training exercise activities. The grid apparatus allows athletes to move forward, backward, side to side, and diagonal at multiple height settings. Specifically, the present invention relates to a grid apparatus that has the ability to be held tight and maintain its shape while on any athletic surface. More specifically, the present invention relates to a grid apparatus that may be suspended above the ground at specific heights. The grid apparatus includes, generally, one or more straps intersecting in a grid configuration and one or more stabilizers to functionally suspend the grid apparatus above the ground.

18 Claims, 5 Drawing Sheets

ATHLETIC AGILITY EQUIPMENT AND METHODS OF USING THE SAME

The present invention claims priority to U.S. Provisional Patent Application No. 61/438,936, filed May 9, 2011, which is incorporated herein by reference in its entirety.

TECHNICAL FIELD

The present invention relates to a grid apparatus that is useful for the training of athletes in speed, agility, strength, plyometrics, balance, cardiovascular and other training exercise activities. The grid apparatus allows athletes to move forward, backward, side to side, and diagonal at multiple height settings. Specifically, the present invention relates to a grid apparatus that has the ability to be held tight and maintain its shape while on any athletic surface. More specifically, the present invention relates to a grid apparatus that may be suspended above the ground at specific heights. The grid apparatus includes, generally, one or more straps intersecting in a grid configuration and one or more stabilizers to functionally suspend the grid apparatus above the ground.

BACKGROUND

It is, of course, generally known to increase strength, speed, power, and performance through training and exercise. Commonly, there are multiple forms of training such as aerobic and anaerobic exercises. Aerobic exercises are usually known as cardio exercises and relate to improving one's oxygen system. Exercises include, generally, long distance running or other performances over long periods of time. Anaerobic exercises are generally highly intensive activities that are performed in short durations. Exercises include, generally, sprinting or other performances over short periods of time. An individual's endurance is generally aerobic while an individual's agility is generally anaerobic. Universally, an athlete is an individual that engages in both aerobic and anaerobic exercises.

It is generally known that agility is the ability to change a body's position efficiently. Increasing agility requires a combination of increasing balance, coordination, speed, reflexes, strength, endurance, and stamina. Increasing agility is most important for professional and recreational sports, when short bursts of exercise are frequently required.

Often, cones, ladders, ropes, and tires are used to increase agility. These pieces of agility equipment are regularly configured in a straight line so an athlete may only train forwards and backwards, or left and right. Each application of these pieces of agility equipment is typically designed to have an athlete step through a series of footwork combinations in specific locations from one end of the equipment to the other.

Frequently, agility equipment is laid directly onto the ground, floor, or other surface without any anchors or weights supporting it. As an athlete progresses through the equipment using footwork combinations, the athlete may trip, fall on, or ultimately become tangled within the agility equipment. When this occurs, all agility exercises utilizing the equipment must halt until the athlete is removed for the equipment and the equipment is repositioned.

Often, agility equipment is suspended a height above the ground. This is generally achieved by using cages to suspend ropes or ladders a foot or more above the ground. Equipment a foot or more above the ground is difficult for athletes to move through quickly and change direction effectively and focuses more on strength than agility. Cages are normally bulky and surround the entire piece of equipment. This typically prevents athletes from entering and exiting the equipment from any direction and may increase the chance of injury if equipment is not used correctly. Bulky pieces of equipment are also difficult to store and take up a substantial amount of space.

A need, therefore, exists for an apparatus that may be used to increase an athlete's agility.

Moreover, a need exists for an apparatus that may allow an athlete to move forwards, backwards, left, right, and diagonally.

Further, a need exists for an apparatus that may be secured to the ground, floor, or other surface to prevent the apparatus from being repositioned.

Additionally, a need exists for an apparatus that may be suspended a height above the ground that allows an athlete to quickly change direction and swiftly move through the apparatus.

Furthermore, a need exists for an apparatus that may not interfere with or increase risk of injury of an athlete while the apparatus is in use.

Moreover, a need exists for an apparatus that may be stored compactly and efficiently.

In addition, a need exists for an apparatus that may allow an athlete to safely enter and exit the apparatus from any direction.

SUMMARY OF THE INVENTION

The present invention relates to a grid apparatus that is useful for the training of athletes in speed, agility, strength, plyometrics, balance, cardiovascular and other training exercise activities. The grid apparatus allows athletes to move forward, backward, side to side, and diagonal at multiple height settings. Specifically, the present invention relates to a grid apparatus that has the ability to be held tight and maintain its shape while on any athletic surface. More specifically, the present invention relates to a grid apparatus that may be suspended above the ground at specific heights. The grid apparatus includes, generally, one or more straps intersecting in a grid configuration and one or more stabilizers to functionally suspend the grid apparatus above the ground.

To this end, in an embodiment of the present invention, agility training equipment is provided. The equipment comprises at least one strap that may separate one area from another and at least two stabilizers that may suspend the at least one strap above the ground.

It is, therefore, an advantage of the present invention to provide an apparatus that may be used to increase an athlete's agility.

Moreover, it is an advantage of the present invention to provide an apparatus that may allow an athlete to move forwards, backwards, left, right, and diagonally.

Further, it is an advantage of the present invention to provide an apparatus that may be secured to the ground, floor, or other surface to prevent the apparatus from being repositioned.

Additionally, it is an advantage of the present invention to provide an apparatus that may be suspended a height above the ground that allows an athlete to quickly change direction and swiftly move through the apparatus.

Furthermore, it is an advantage of the present invention to provide an apparatus that may not interfere with or increase risk of injury of an athlete while the apparatus is in use.

Moreover, it is an advantage of the present invention to provide an apparatus that may be stored compactly and efficiently.

In addition, it is an advantage of the present invention to provide an apparatus that may allow an athlete to safely enter and exit the apparatus from any direction.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present embodiments, by way of example only, not by way of limitations. In the figures, like reference numerals refer to the same or similar elements.

DETAILED DESCRIPTION OF THE PRESENTLY PREFERRED EMBODIMENTS

The present invention relates to a grid apparatus that is useful for the training of athletes in speed, agility, strength, plyometrics, balance, cardiovascular and other training exercise activities. The grid apparatus allows athletes to move forward, backward, side to side, and diagonal at multiple height settings. Specifically, the present invention relates to a grid apparatus that has the ability to be held tight and maintain its shape while on any athletic surface. More specifically, the present invention relates to a grid apparatus that may be suspended above the ground at specific heights. The grid apparatus includes, generally, one or more straps intersecting in a grid configuration and one or more stabilizers to functionally suspend the grid apparatus above the ground.

Although the present invention is described in relation to a strap grid used during agility training, it should be apparent to one of ordinary skill in the art that the components of the present invention, as described in the embodiments presented herein, may be useful for other training exercises.

Figure 1:
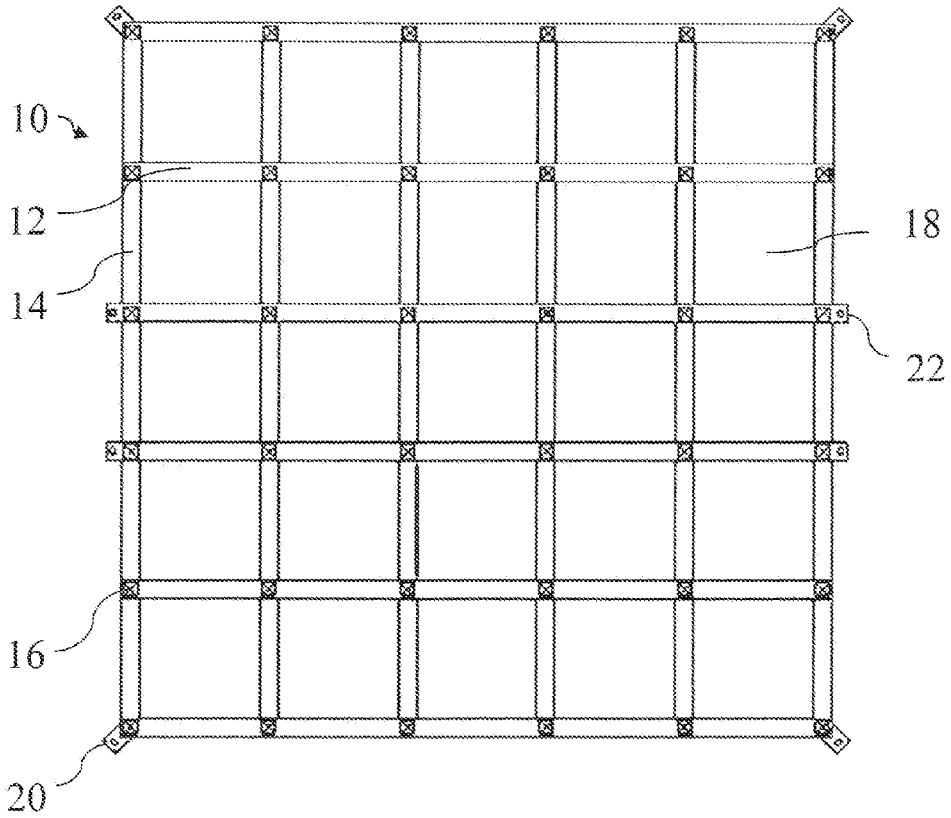
FIG. 1 illustrates a top-down view of an embodiment of the present invention for use in agility training.

Now referring to the figures, wherein like numerals refer to like parts, an embodiment of the present invention is provided in FIG. 1. A grid apparatus 10 may comprise a plurality of horizontal straps 12 and a plurality of vertical straps 14 positioned in the shape of a grid. Horizontal straps 12 may be sewn together with vertical straps 14 with a plurality of stitches 16 so that a plurality of spaces 18 may be formed between two or more horizontal straps 12 and two or more vertical straps 14. Spaces 18 may allow an athlete to perform footwork drills by constraining where the athlete can step. Grid apparatus 10 may preferably include a plurality of spaces. In the embodiment shown in FIG. 1, grid apparatus 10 includes twenty-five spaces 18, however the grid apparatus of the present invention may comprise any number of spaces 18 that allow an athlete to move forwards, backwards, left, right, and diagonally between spaces 18 in grid apparatus 10.

In a preferred embodiment of the present invention, grid apparatus 10 may include a first group of six straps made from a durable yet flexible material, such as nylon, that may be about one inch thick and about ten feet long, laid parallel to each other and spaced about two feet apart to create five lanes. This first group of six straps may be intersected with a second group of six straps, also made from a durable yet flexible material, such as nylon, that may also be about one inch thick and about ten feet long that may also be laid parallel to one another and spaced about two feet apart to also create five lanes. Together, the first group of six straps and the second group of six straps forms a grid having a plurality of squares. In the preferred embodiment described herein, the grid may have twenty-five squares, each of the squares being about two feet by two feet. The squares are sized to allow a user to step into each square when utilizing the grid. Of course, the grid may contain more or less squares than described herein, and the grid may be configured in any shape apparent to one of ordinary skill in the art.

Figure 5:
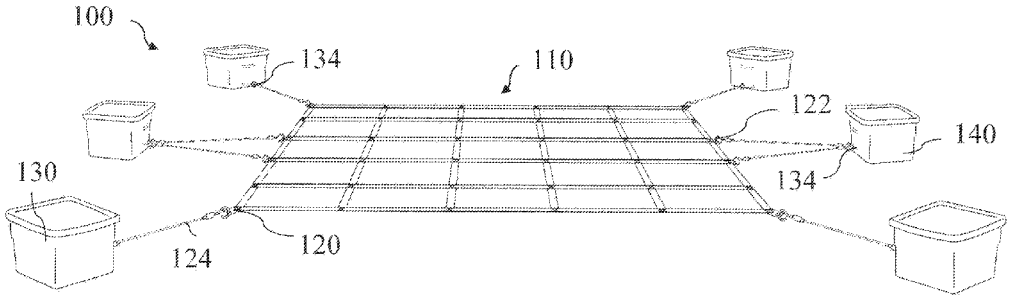
FIG. 5 illustrates a perspective view of the preferred embodiment of the present invention for use in agility training on the ground.
Figure 6:
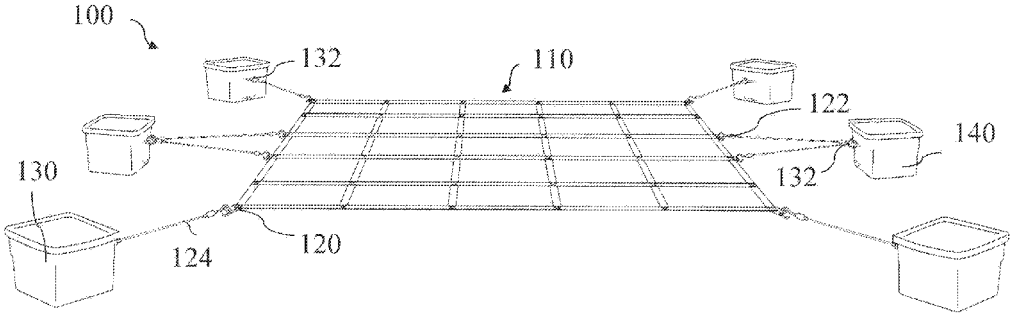
FIG. 6 illustrates a perspective view of the preferred embodiment of the present invention for use in agility training suspended a height above the ground.

Grid apparatus 10 may be placed directly onto the ground or may be suspended a height above the ground. Grid apparatus 10 may further comprise a plurality of corner mounts 20 and a plurality of side mounts 22. The corner mounts 20 and/or the side mounts 22 may allow for the stabilizers, as described below, to be attached to specific locations of the grid apparatus 10. For example, the corner mounts 20 and/or the side mounts 22 may be grommets to provide a location for a securing or tethering means to be attached thereto, as described below. Additionally, the corner mounts 20 may allow grid apparatus 10 to be suspended a height above the ground by securing each corner to a stabilizer, as shown in FIGS. 5 and 6. The side mounts 22 may prevent the midsection of grid apparatus 10 from sagging by securing the sides to a stabilizer, as shown in FIGS. 5 and 6. Placing grid apparatus 10 on the ground may allow an athlete to improve the speed, agility, strength, plyometrics, balance, and anaerobic techniques by performing footwork drills through grid apparatus 10 in a short amount of time. Suspending grid apparatus 10 a height above the ground may allow an athlete to improve the speed, agility, strength, plyometrics, balance, and anaerobic techniques by altering the height at which an athlete performs footwork drills through grid apparatus 10 in a short amount of time.

In an alternative embodiment of the present invention, a plurality of grid apparatuses, as described above, may be connected together to form larger grids. Specifically, grid apparatuses of the present invention may include snaps, buttons, or other securing means for connecting a first grid apparatus to a second grid apparatus, such as along the outside perimeter of each grid apparatus. For example, if a first grid apparatus is a 25×25 square grid, and a second grid apparatus is a 25×25 square grid, connecting the first and second grid apparatuses together may allow a user to form a 25×50 square grid.

Figure 2:
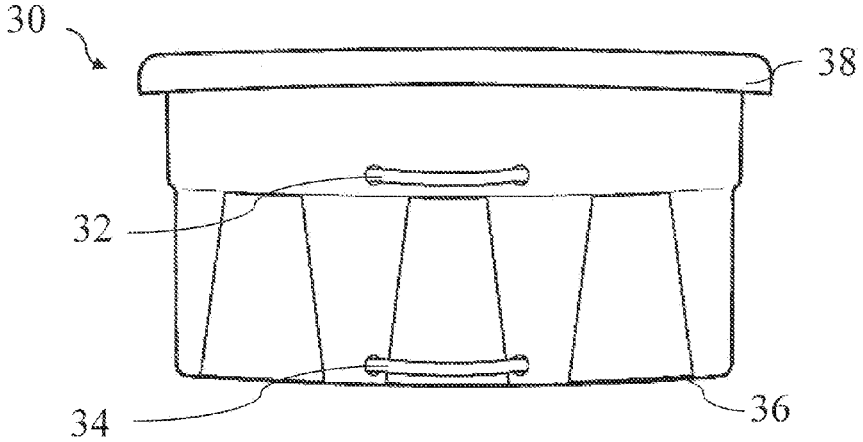
FIG. 2 illustrates a front view of a stabilizer for use in an embodiment of the present invention.

Referring now to FIG. 2, a stabilizer 30 is shown and described in an embodiment of the present invention. Stabilizer 30 may comprise of a raised attachment 32 and a ground-level attachment 34. Raised attachment 32 may allow a grid apparatus, as shown in FIG. 6, to be held taut and suspended a height above the ground. Ground-level attachment 34 may allow the grid apparatus, as shown in FIG. 5, to be held taut on, near or otherwise along the ground so an athlete may not become tangled in the grid apparatus. Stabilizer 30 may further comprise an elastomeric coating 36 or other grip means that may allow stabilizer 30 to grip to smooth surfaces. Stabilizer 30 may be filled with sand, weights, or another heavy substance known to one skilled in the art that may allow stabilizer 30 to anchor the grid apparatus. Stabilizer 30 may also be filled with the grid apparatus, as shown in FIG. 3B, when not in use. A lid 38 may be disposed on top of stabilizer 30 and may keep the grid apparatus, sand, weights, or another heavy substance known to one skilled in the art contained within the stabilizer 30.

Figure 3A:
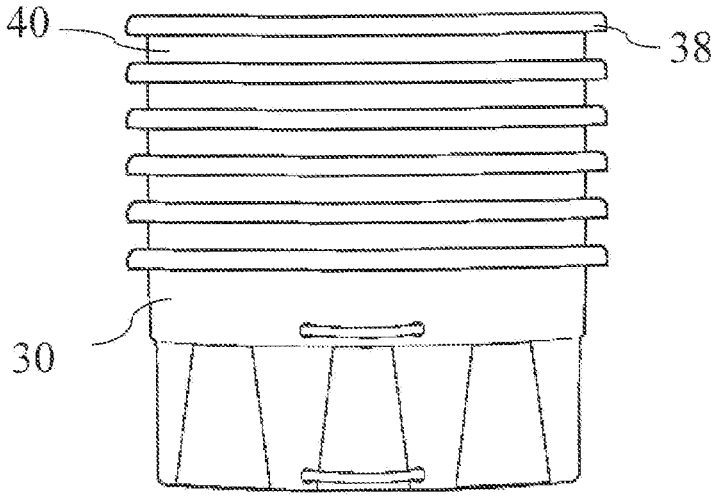
FIG. 3A illustrates a side view of a stack of stabilizers for use in an embodiment of the present invention.
Figure 3B:
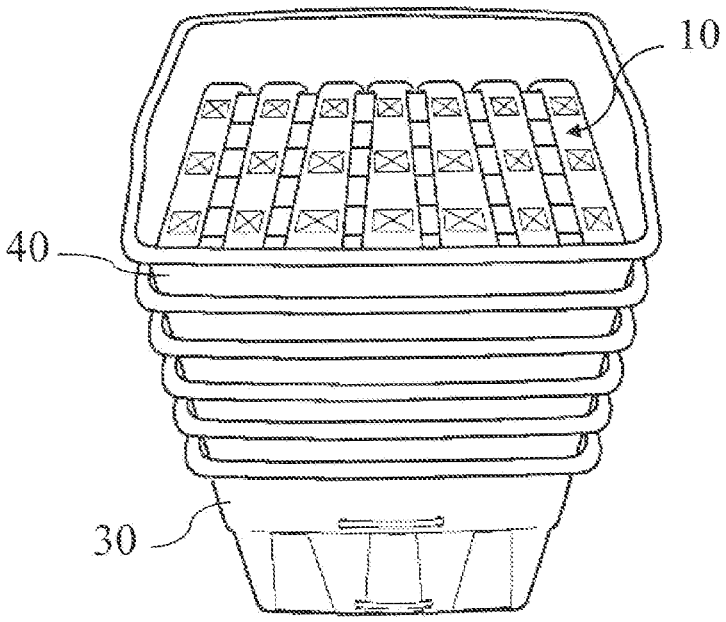
FIG. 3B illustrates a perspective view of a stack of stabilizers for use in an embodiment of the present invention.

Referring now to FIG. 3A, a plurality of stabilizers 30 are shown and described in an embodiment of the present invention. Stabilizers 30 may be stacked vertically on top of one another in order to save space. Lid 38 may be disposed on a topmost stabilizer 40 and may keep the grid apparatus, sand, weights, or another heavy substance or material known to one skilled in the art contained within the topmost stabilizer 40.

Referring now to FIG. 3B, a plurality of stabilizers 30 are shown and described in an elevated perspective view of the present invention. Stabilizers 30 may be stacked vertically on top of one another in order to save space. The topmost stabilizer 40 may be filled with grid apparatus 10 when grid apparatus 10 is not in use and for storage thereof. The topmost stabilizer 40 may also be filled with a plurality of ropes, chains, cables, bungee cords, or another object capable of tethering known to one of ordinary skill in the art.

Figure 4:
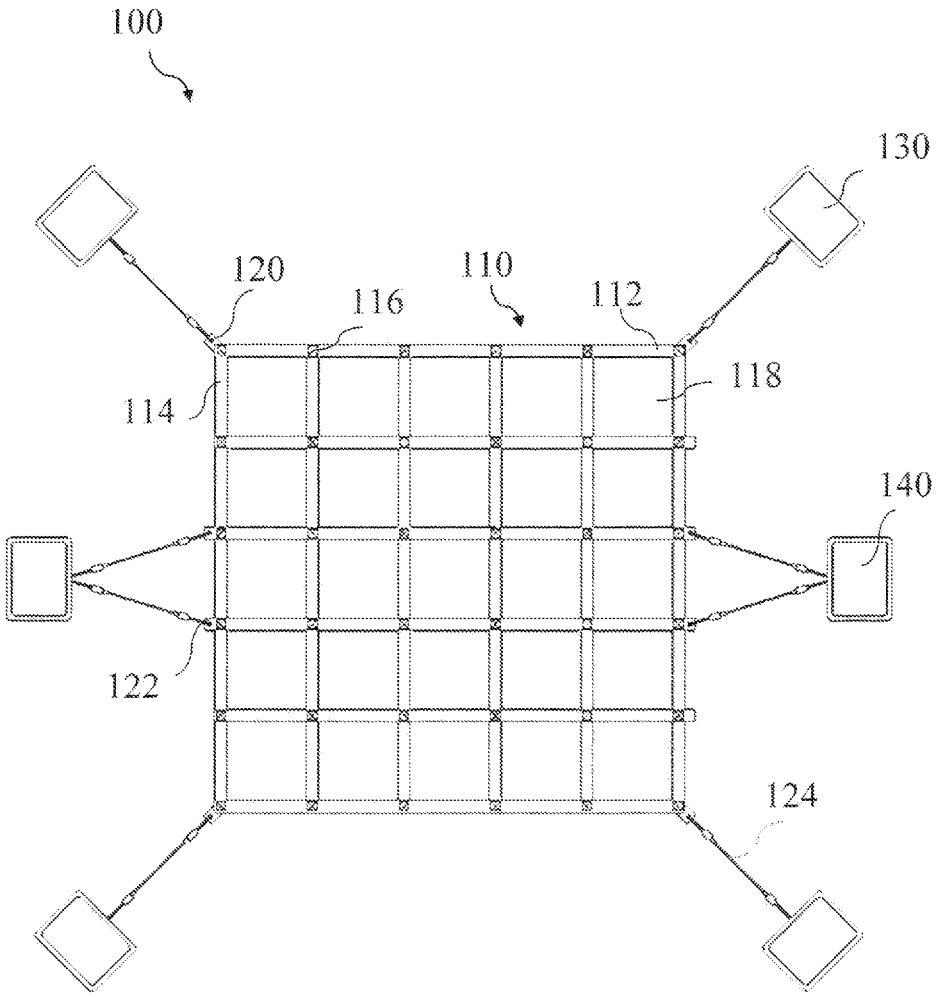
FIG. 4 illustrates a top-down view of a preferred embodiment of the present invention for use in agility training.

Referring now to FIG. 4, a preferred embodiment of the present invention is shown and described. A grid system 100 may comprise a grid apparatus 110, a plurality of corner stabilizers 130, and a plurality of side stabilizers 140. Grid apparatus 110 may comprise a plurality of horizontal straps 112 and a plurality of vertical straps 114 positioned in the shape of a grid. Horizontal straps 112 may be sewn together with vertical straps 114 with a plurality of stitches 116 so that a plurality of spaces 118 may be formed between two or more horizontal straps 112 and two or more vertical straps 114. Spaces 118 may allow an athlete to perform footwork drills by constraining where the athlete can step.

Grid apparatus 110 may be placed directly onto the ground or may be suspended a height above the ground. Grid apparatus 110 may further comprise a plurality of corner mounts 120 and a plurality of side mounts 122. The corner mounts 120 may allow grid apparatus 110 to be suspended a height above the ground by securing each corner to a corner stabilizer 130. The side mounts 122 may prevent the midsection of grid apparatus 110 from sagging by securing the sides to a side stabilizer 140. Corner stabilizers 130 may attach to corner mounts 120 via a plurality of bungee cords 124. Bungee cords 124 may alternately be ropes, chains, cables, or other objects capable of tethering known to one of ordinary skill in the art that may hold grid apparatus 110 taut. Side stabilizers 140 may attach to side mounts 122 via one or more bungee cords 124 or other like tethering means. Corner stabilizers 130 and side stabilizers 140 may be filled with sand, weights, water or another relatively heavy substance known to one skilled in the art that may prevent corner stabilizers 130 and side stabilizers 140 from moving during use.

Referring now to FIG. 5, a perspective view of a preferred embodiment of the present invention is shown and described. Grid system 100 may comprise grid apparatus 110 disposed on the ground. Corner mounts 120 may be attached to corner stabilizers 130 by connecting or otherwise fastening bungee cords 124 to a plurality of ground-level attachments 134. Side mounts 122 may be attached to side stabilizers 140 by connecting or otherwise fastening one or more bungee cords 124 to ground-level attachments 134. Placing grid apparatus 110 on, near or otherwise along the ground may allow an athlete to improve the speed, agility, strength, plyometrics, balance, and anaerobic techniques by performing footwork drills through grid apparatus 110 in a short amount of time.

Referring now to FIG. 6, a perspective view of an alternate preferred embodiment of the present invention is shown and described. Grid system 100 may comprise grid apparatus 110 disposed a height above the ground. Corner mounts 120 may be attached to corner stabilizers 130 by connecting or otherwise fastening bungee cords 124 to a plurality of raised attachments 132. Side mounts 122 may be attached to side stabilizers 140 by connecting or otherwise fastening one or more bungee cords 124 to raised attachments 132. Suspending grid apparatus 110 a height above the ground may allow an athlete to improve the speed, agility, strength, plyometrics, balance, and anaerobic techniques by altering the height at which an athlete performs footwork drills through grid apparatus 110 in a short amount of time.

Corner mounts 120 and side mounts 122 may be used to attach an alternate grid apparatus (not shown) to grid apparatus 110 for alternate designs and paths of grid system 100. Grid apparatus 110 may not be limited by the size and grid shown in the previous figures and may be of any shape or size such that an athlete can perform footwork drills forwards, backwards, left, right, and diagonally. For example, grid apparatus 110 may be rectangular, triangular, circular, maze-like, any other design known to one with ordinary skill in the art, or any combination thereof.

Figure 7:
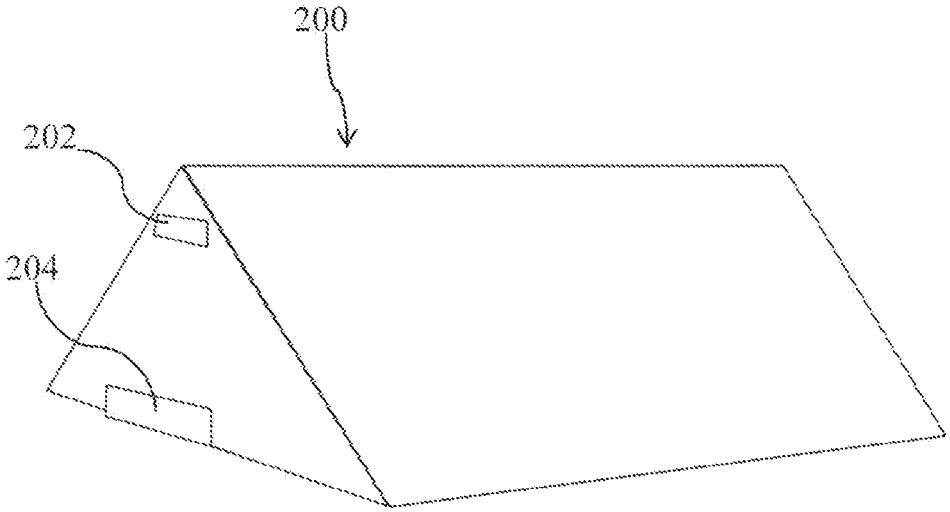
FIG. 7 illustrates a perspective view of a stabilizer in an embodiment of the present invention.

FIG. 7 illustrates an alternate embodiment of a stabilizer 200 that may be utilized in the present invention to hold the grid apparatus, as described above, at its various locations. Specifically, the stabilizer 200 may be a pyramidally-shaped, or triangular prism-shaped, weighted material, such as a solid weight, water-filled, a sandbag or the like. Of course, the stabilizer may be any shape that may be useful in preventing or minimizing the movement of the grid when set up. In a preferred embodiment, the stabilizer 200 may be a sandbag.

The stabilizer 200 may be utilized in place of the stabilizers illustrated in FIGS. 4, 5 and 6, and may be utilized to adequately hold the grid apparatus in its position. Moreover, a plurality of connection points 202, 204 may be provided on the stabilizer 200 for connecting to a grid apparatus. When a grid apparatus is attached to connection point 202, the grid apparatus, as described above, may be held a first distance above a surface, such as a floor, or the ground. Moreover, when a grid apparatus is attached to connection point 204, the grid apparatus, as described above, may be held at ground level or a second distance above the surface, such as a floor or the ground.

In addition, the stabilizers, as described herein, may include a gripping material to more effectively hold the stabilizers in position and prevent or minimize sliding on a surface, such as a floor or the like. In addition, spuds or stakes may extend from the stabilizers as described herein for pushing into the ground for holding the same in position, as needed.

In a method of using the grid apparatus and systems of the present invention, as described herein, a user may enter the grid by one or both of his or her feet into the grid, and may be required to quickly move from one square in the grid to another square in the grid, either randomly, or via a particular two-dimensional pattern. In addition, a user of the grid apparatus and systems of the present invention, as described herein, may be required to step through the squares of the grid from any entry point, and exit the grid through any exit point, giving the user a great deal of freedom when utilizing the same. By requiring the user to move through the squares of the grid in a particular pattern, the user's mental capabilities, as well as the physical capabilities, may be heightened. Moreover, a plurality of users may utilize the grid apparatus and systems described herein at the same time, each moving through the squares of the grid in each one's particular pattern, thus requiring a user to ensure that the pattern is followed so as not to interfere with another user of the grid.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. An agility training apparatus for use above a floor surface comprising:

a first plurality of parallel straps;

a second plurality of parallel straps, wherein the first plurality of straps are roughly perpendicular to the second plurality of straps to form a grid having a plurality of polygonal spaces bounded by the first and second plurality of straps, wherein the grid forms a plane that is roughly parallel with the floor surface; and a first stabilizer comprising a base and an internal storage area connected with at least one of the first plurality of straps, the base of the first stabilizer disposed on the floor surface and having a connector at a first height, said at least one of the first plurality of straps connected to the connector, wherein the first stabilizer secures the grid horizontally above the floor surface at the first height, wherein the first and second areas are so positioned as to allow a user to step into the first and second areas and further wherein the internal storage area of the first stabilizer is configured to hold the grid when not in use.

2. The agility training apparatus of claim 1 further comprising:

a second stabilizer comprising a base and an internal storage area connected with the second plurality of straps, wherein the second stabilizer secures the first and second areas at the first height above the floor surface.

3. The agility training apparatus of claim 2 further comprising:

a second connector connected to at least one of the second plurality of straps, wherein the second connector connects at least one of the second plurality of straps to the second stabilizer.

4. An agility training system comprising:

a floor surface;

an agility training apparatus comprising a first plurality of parallel straps running in a first direction, and a second plurality of parallel straps running in a second direction, the first plurality of parallel straps and the second plurality of parallel straps forming a grid having a perimeter and a plurality of spaces between the first and second plurality of straps, said plurality of spaces positioned horizontally above the floor surface roughly parallel with the floor surface;

a first stabilizer comprising a base and an internal storage area connected to the grid for securing the agility training apparatus, the base of the first stabilizer disposed on the floor surface and having a connector at a first height above the floor surface, said grid connected to the connector at a point around the perimeter of the grid;

wherein the grid is so positioned as to allow a user to step into one or more of the plurality of spaces and further wherein the internal storage area of the first stabilizer is configured to hold the grid when not in use.

5. The agility training system of claim 4 further comprising:

a second stabilizer comprising a base and an internal storage area connected to the agility training apparatus for securing the agility training apparatus.

6. The agility training system of claim 4 wherein the grid comprises a first corner, and further wherein the first stabilizer is connected to the agility training apparatus at the first corner.

7. The agility training system of claim 5 wherein the grid comprises a first corner and a second corner, and further wherein the first stabilizer is connected to the agility training apparatus at the first corner, and further wherein the second stabilizer is connected to the agility training apparatus and the second corner.

8. The agility training system of claim 5 wherein the grid comprises a first corner, a second corner, and a length of strap between the first corner and the second corner, wherein the first stabilizer is connected to the agility training apparatus at the first corner, and further wherein the second stabilizer is connected to the agility training apparatus at a point on the length of strap between the first corner and the second corner on the perimeter of the grid.

9. The agility training system of claim 4 wherein the grid comprises a first corner, a second corner, a third corner and a fourth corner, and further comprising: a second stabilizer, a third stabilizer and a fourth stabilizer, wherein the first stabilizer is connected to the grid at the first corner, the second stabilizer is connected to the grid at the second corner, the third stabilizer is connected to the grid at the third corner, and the fourth stabilizer is connected to the grid at the fourth corner.

10. The agility training system of claim 4 wherein the first stabilizer is weighted.

11. The agility training system of claim 4 wherein the first stabilizer is a container having a weight disposed therein.

12. The agility training system of claim 4 wherein the floor surface is the ground.

13. The agility training system of claim 4 wherein the first stabilizer comprises a sandbag.

14. The agility training system of claim 4 wherein the first stabilizer has a first connection point and a second connection point, wherein the grid is connectable to the first stabilizer at the first connection point or the second connection point.

15. The agility training system of claim 14 wherein the first connection point holds the grid at a first distance above the floor surface when connected to the grid, and further wherein the second connection point holds the grid at a second distance above the floor surface when connected to the grid.

16. The agility training system of claim 4 wherein the first plurality of parallel straps and the second plurality of parallel straps form open areas whereupon a user places his feet therein.

17. The agility training apparatus of claim 2 wherein the second stabilizer is configured to nest within the first stabilizer.

18. The agility training system of claim 5 wherein the second stabilizer is configured to nest within the first stabilizer.

* * * * *